US006907765B2

(12) United States Patent
Sautter et al.

(10) Patent No.: US 6,907,765 B2
(45) Date of Patent: Jun. 21, 2005

(54) RAM-SIDE EJECTOR DEVICE FOR WORKPIECES IN SINGLE-OR MULTI-STAGE PRESSES

(75) Inventors: Dietmar Sautter, Lichtenstein (DE); Werner Goedtner, Reutlingen (DE); Udo Kuehne, Sulz-Bergfelden (DE)

(73) Assignee: WAFIOS Aktiengesellschaft, Reutlingen (DE)

( * ) Notice: Subject to any disclaimer, the term of this patent is extended or adjusted under 35 U.S.C. 154(b) by 79 days.

(21) Appl. No.: 10/375,184

(22) Filed: Feb. 27, 2003

(65) Prior Publication Data

US 2003/0159492 A1 Aug. 28, 2003

(30) Foreign Application Priority Data

Feb. 28, 2002 (DE) ..... 102 08 720

(51) Int. Cl.[7] ..... B21J 13/14
(52) U.S. Cl. ..... 72/345; 470/152
(58) Field of Search ..... 72/344, 345, 427; 470/152

(56) References Cited

U.S. PATENT DOCUMENTS 2,187,479 A 1/1940 Zwierlein
3,299,453 A * 1/1967 Van De Meerendonk ... 470/137
3,712,107 A * 1/1973 Duhan ..... 72/345
3,911,718 A * 10/1975 Requarth ..... 72/342.3

FOREIGN PATENT DOCUMENTS

GB 448136 6/1936

* cited by examiner

*Primary Examiner*—Lowell A. Larson
(74) *Attorney, Agent, or Firm*—Patterson, Thuente, Skaar & Christensen, P.A.

(57) ABSTRACT

A ram-side ejector device for shaping presses comprising a press carriage, which is movable between a pressing position extended relative to a stationary press die and an end position at a distance therefrom and comprises a press ram cooperating with the stationary press die, said presses further comprising an ejector pin carried on the press carriage the pressing direction and penetrating the press ram, said ejector pin being movable between a retracted end position, in which it is supported, by its end remote from the die, on a stop formed on the press carriage, and an extended position protruding from the press ram, wherein the end of said pin remote from the die is distanced from the stop, said pin being provided with a resetting means which acts counter to the direction in which said pin is extended and which may be releasably blocked, when the press carriage returns from its pressing position, by a blocking means fixed to the press frame counter to the return movement of the press carriage, the activation or deactivation of the blocking means and the activation of the resetting means being program-controlled and coupled with each other, characterized in that the blocking means comprises a positionally adjustable blocking element, which may be retracted into blocking engagement with the ejector pin or with a part connected therewith, while the ejector pin contacts the stop.

17 Claims, 4 Drawing Sheets

RAM-SIDE EJECTOR DEVICE FOR WORKPIECES IN SINGLE-OR MULTI-STAGE PRESSES

CROSS REFERENCE TO RELATED APPLICATIONS

This application claims priority to German Patent Application File No. 102 08 720.2, filed Feb. 28, 2002, which is hereby incorporated by reference herein.

BACKGROUND OF THE INVENTION

The invention relates to a ram-side ejector device for workpieces in single- or multi-stage presses, said presses comprising a press carriage, which is movable between a pressing position extended relative to a stationary press die and an end position at a distance therefrom and comprises a press ram cooperating with the stationary press die, further comprising an ejector pin carried on the press carriage in the pressing direction and penetrating the press ram, said ejector pin being movable between a retracted end position, in which said pin is supported, by its end remote from the die, on a stop formed on the press carriage, and an extended position protruding from the press ram, wherein the end of said pin remote from the die is distanced from the stop, said pin being provided with a resetting means acting counter to the direction in which said pin is extended and which may be releasably blocked, when the press carriage returns from its pressing position, by a blocking means fixed to the press frame counter to the return movement of the press carriage, the activation or deactivation of the blocking means and the activation of the resetting means being program-controlled and coupled with each other.

Such ejecting devices serve to eject workpieces on the ram side of single- or multi-stage presses, such workpieces including in particular screws, bolts, rivets or similar parts. The ejecting operation is integrated in the press operation cycle.

Devices for generating a ram-side ejection movement after the pressing operation in order to release and eject workpieces from the tools, e.g. from hexagon-head rams on automatic shaping presses, have long since been known. For this purpose, a movement is initiated from outside, i.e. either from the press frame (e.g. DE 24 50 631 C) or from the crankshaft (e.g. DE 1 750 033 C) into the press carriage of the shaping press, wherein the desired ejection movement is then generated via cam plates, angle levers or other transmission elements. However, these known ejector systems have the disadvantage that they are provided, in many cases, with many joints, levers, gearwheels and the like, and have a considerable mass which is to be moved together with the press carriage and is thus excited to vibrate. Moreover, these known ejector systems also have a certain stroke which causes the workpiece to be released first from the stationary die of the shaping press before being released from the moving ram of the press, which may result in the workpiece being lost before it can be securely taken, for example, by the gripping fingers of the transfer device of the press. A further disadvantage is that a change in the law of motion of the press carriage, for example when the carriage stroke changes, also requires a cumbersome change in the law of motion of the ram-side ejector, with the ejection stroke being changeable, in most cases, only with great effort.

As an overload safety device, the known ejector systems are usually provided with a breakage safety device which has to be renewed after being triggered.

Further, DE 100 07 255 A discloses a ram-side ejector device wherein an ejector lever can act upon the end of the ejector pin remote from the die, said ejector pin penetrating the ram, with the end of the ejector lever acting upon the end of the ejector pin being interposed between the latter and a stop on the press carriage and continuously contacting the end of the ejector pin remote from the die, even upon the return of the press carriage after the pressing operation. The return movement of the press carriage, the ejector lever is fixed in its position, immobilized relative to the frame, by means of a toggle connection and by an activatable solenoid such that said solenoid urges the ejector lever out of the press ram for the ejection movement during the return movement of the press carriage. Only if the desired ejection movement has been performed by the ejector pin, i.e. once it has been moved into the desired, fully extended position, the blocking of the ejector pin in its position fixed relative to the housing is eliminated by deactivating the solenoid. At the same time, the resetting means is activated, by which the ejector lever is retracted into the press carriage again and, thus, the ejector lever having its end contact the end of the ejector pin remote from the die is simultaneously tilted until it contacts the stop fixed relative to the housing. This return movement of the ejector lever is further supported by a spring prestressing it in this direction.

The toggle connection of the ejector lever, which is tiltably supported on the press frame, is simultaneously usable as an overload safety device which responds in order to protect the shaping press if the force by which the workpiece has to be urged out of the ram by means of the ejector pin exceeds a preadjusted level, for example upon tool breakage. The toggle lever system then bends in, because the programmably adjusted holding force of the solenoid is exceeded, which can be recognized by the program control of the shaping press enabling immediate stopping of the press. Thus, a renewal of the breakage safety device as required in the previously known ejector systems is not required in this case.

By the programmable selection of the switch-off time of the current supply to the solenoid during the return movement of the press carriage, the time period during which the ejector pin is immobilized, and thus the ejector stroke, may be easily predetermined, so that each ejector pin of multi-stage presses may be individually adjusted via the program control of the press. The cumbersome change of the law of motion for the ram-side ejector upon a change in the law of motion of the press carriage required in previous ejector systems is thus dispensed with.

While this known ejector device already essentially solves problems of previously known ejector devices in an excellent manner, it still suffers from relatively large masses of the system due to the ejector lever employed and its toggle lever connection comprising the solenoid blocking mechanism on the press frame, and it is, thus, not usable at higher operating speeds of the press (approx. over 50 pressing operations per minute).

In view thereof, it is an object of the invention to improve such ejector device in such a way that the total mass of the ejector system can still be reduced further and that, in particular, use thereof is possible also at higher press speeds in the range of over 50 press strokes per minute.

SUMMARY OF THE INVENTION

According to the invention, this object is achieved by a ram-side ejector device of the above-mentioned type in that the means for blocking comprises a blocking mechanism with a positionally shiftable blocking element which can be retracted into blocking engagement with the ejector pin or with a part connected therewith in the pressing position of the press carriage, while the ejector pin is in contact with the stop.

The invention provides a ram-side ejector device wherein, in contrast to the device mentioned above, the blocking means need no longer be maintained in continuous contact with the ejector pin and be blocked at a certain location. Rather, according to the invention, the blocking means uses a positionally shiftable blocking element, which is not retracted or moved into blocking engagement with the ejector pin (or with a part connected therewith) until the press carriage has been brought into its pressing position, while the ejector pin is still in engagement with the stop fixed relative to the housing. This allows the force acting upon the ejector pin in its longitudinal direction as a result of the pressing operation to be securely supported via the ejector pin contacting the stop on the press carriage without interposition of the blocking element, wherein the latter can only be brought into blocking engagement with the ejector pin (or with a part thereof) and thus the immobilization can be performed directly on the ejector pin (or on the part connected therewith), when it has reached its ejection position, at the time when the blocking effect is desired. In the invention, in contrast to the above-mentioned device, there is no longer any movement of the blocking means caused by displacements of the press carriage, so that there is thus no comovement of the blocking means even during fast movements of the carriage, i.e. during high press cycles. According to the invention, the blocking means only serves to block the ejector pin in its position relative to the press frame during the return of the press carriage (or only for part of its return movement) and, thus, to cause the extension movement of the ejector pin. Once this has been achieved, the blocking means is moved out of the blocking engagement again and is thus not involved in the moving masses in the further return movement of the press either. Thus, the blocking means is completely eliminated as a moving mass during displacement of the carriage, which has the advantage that it does not vibrate either. The adjustment movements which become necessary in the blocking means in order to move it in and out of this blocked position, may be chosen to be relatively small so that, also in this regard, rapid execution of these adjustment movements at high press speeds is easily realized.

In the press according to the invention, the blocking means can easily be formed such that its release upon a certain predeterminable force being exceeded is forced in the longitudinal direction of the ejector pin in a form-fit manner, thus obtaining an overload safety device operating in a wear-free manner. A change in the ejection length of the ejection stroke is also easily realized by the program control of the blocking means in terms of the duration of the blocking effect and is thus easily adjustable to different laws of movement of, e.g., a multi-stage press.

The ram-side ejector device according to the invention has a particularly small mass, the ejection movement occurring independently of the law of movement of the press carriage and the workpieces being maintained in the stationary tool (namely the die) without any significant spring action.

It is particularly advantageous, in the ejector device according to the invention, if the blocking element is a shaped part which can be made to contact a complementary shape of the ejector pin or of a part connected therewith in order to block the ejector pin, wherein exactly such form-fit blocking can be provided without any difficulty in such a manner that said blocking is also automatically released in a form-fit manner when overload occurs. Particularly preferably, for example, the shaped part may be provided in the form of a sprocket wheel which is urged against a corresponding oblique butting face on the ejector pin. In doing so, automatic release of said blocking is easily effected by correspondingly adjusting the contacting force of the sprocket wheel against said face until a predetermined longitudinal force occurs in the longitudinal direction of the ejector pin (which is effective in the blocking direction).

A particularly preferred embodiment of the ejector device according to the invention is obtained by providing the shaped part on a piston rod which is slidably supported in a valve block and is displaceable by means of a pressure fluid between an extended blocking position and a retracted end position (which may comprise, e.g., full or partial retraction into the valve block) with no blocking engagement. Such embodiment of the blocking means, operating as a hydraulic double piston which can be retracted and extended in the direction of displacement, not only allows quick switching and adjustment movements (both to-and-fro), but also leads to relatively small moving masses and to an exactly selectable (and adjustable) blocking effect.

While the piston rod may be actuated in any suitable manner, it is particularly preferably actuated in a hydraulic manner.

A further advantageous embodiment of the ejector device according to the invention also consists in that the ejector pin is provided with a piston rod (as "a part connected therewith") at its end remote from the die, on which piston rod the shape for blocking engagement with the blocking element is mounted. For this purpose, an oblique surface is provided preferably on the end of the piston rod remote from the die, on the side of the piston rod facing the blocking element, as a contacting surface for the shaped part. This results in a preferable function of the ejector device according to the invention with only very little structural complexity.

Advantageously, the ejector device according to the invention is further embodied such that the ejector pin can be returned not only to its retracted position by means of the resetting means, but the resetting means is also provided such that the ejector pin is additionally moveable also in its extension direction, which leads to the advantage that the ejector pin can also be used, for example, in order to slide a prefabricated workpiece into the die and to hold it there in order to yield in a resilient manner during the actual pressing operation, when the resetting means is actuated, for example, by means of a pressure gas.

The blocking means, which has to be fixed in a suitable manner relative to the frame, independently of the movement of the press carriage, is preferably embodied such, in an ejector device according to the invention, that it protrudes into a recess in the press carriage until it is close to the ejector pin or to the part connected therewith. This allows to achieve the advantage that, in order to effect said blocking engagement, the blocking means merely needs to carry out relatively small movements of extension for the blocking element, which allows rapid blocking (as well as rapid release of said blocking).

BRIEF DESCRIPTION OF THE FIGURES

The invention will be explained hereinafter essentially by way of example, with reference to the Figures, wherein:

FIGS. 1 to 4 basically show a constructive arrangement of a ram-side ejector system, with the individual Figures, however, showing different positions during a press cycle. Identical components in the various Figures are identified by the same numerals.

DETAILED DESCRIPTION OF PREFERRED EMBODIMENTS OF THE INVENTION

Figure 1:
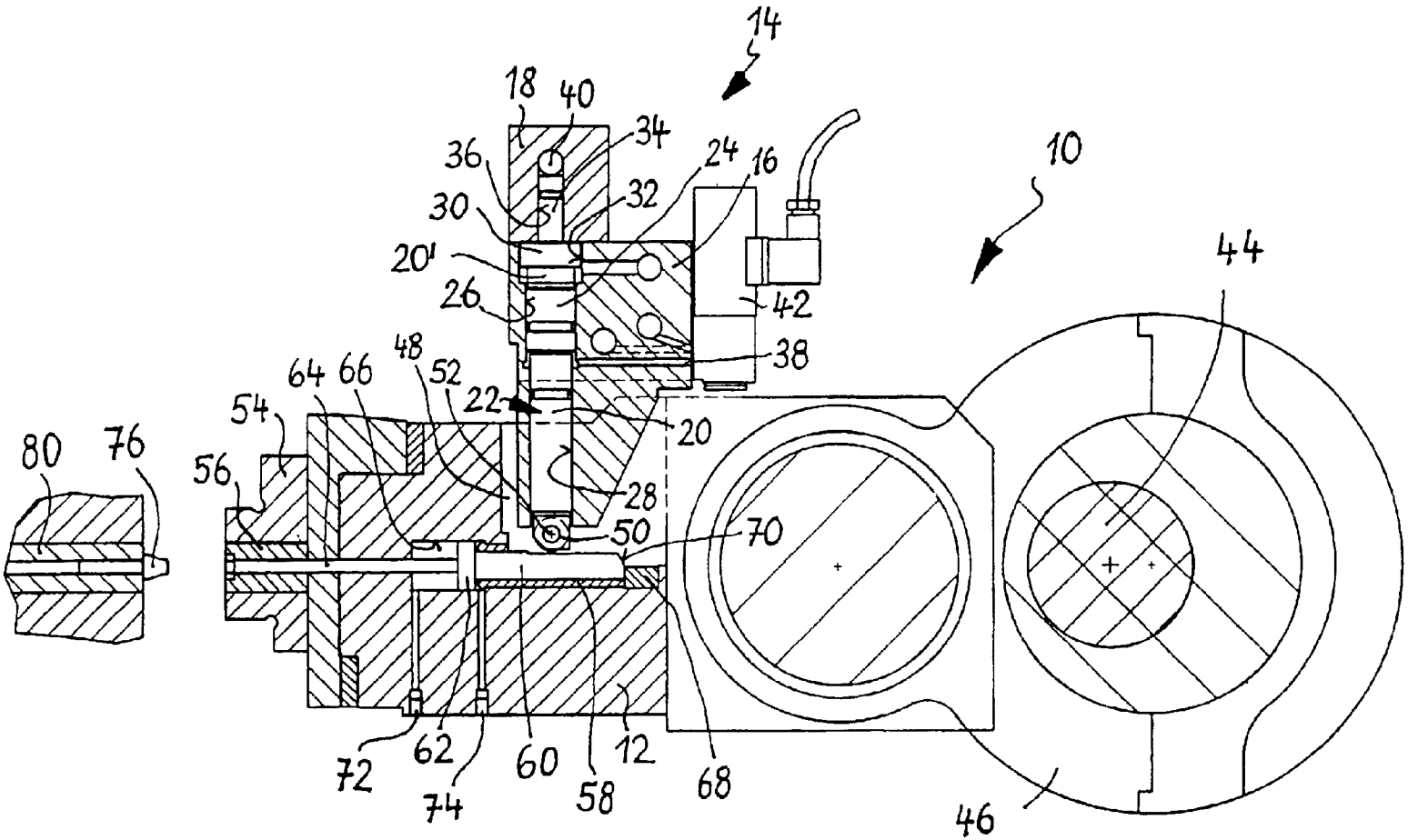
FIG. 1 shows a side view, in partial section, of a ram-side ejector device according to the invention in a first end position at the rear dead center of the press carriage, at the beginning of a press cycle of the press.

The ram-side ejector device 10, the constructional details of which are represented in the Figures by way of example only, is part of a single- or multi-stage press comprising a press carriage 12, which is guided in a reciprocating manner in a press frame (not shown). The latter serves to manufacture, optionally one by one, finished workpieces from blanks using carriage-side shaping tools (rams) and stationary dies.

Further, there is provided a valve block 14, which is mounted on the press frame (not shown) and consists of a lower part 16 as well as of an upper part 18, which are securely screw-fastened with each other and, together, form a machine frame.

A lower part 20 of a piston rod 22 as well as a piston 24 integrally connected with the piston rod 22 are slidably supported in the lower valve block part 16. The piston 24 slides within a cylinder bore 26, while the lower piston rod portion 20 is guided within a guiding bore 28 of the lower valve block part 16.

In the lower valve block part 16, the piston 24 is upwardly joined by a piston rod 20' and terminates in a thickened end part 30, which is also guided in a guiding bore 32 in the upper valve block part 18.

Further, a plunger 34 embodied as a piston is slidably supported in a cylinder bore 36 in the upper valve block part 18 and contacts the thickened end 30 of the piston rod 22.

The valve block parts 16 and 18 are provided with hydraulic feed and withdrawal lines 38 and 40, respectively, which terminate in the cylinder bores 26 and 36, respectively. A hydraulic valve 42 is also attached to the lower valve block part 16.

The press carriage 12 is movable to-and-fro by a crank shaft 44 via push rods 46 and is provided with an externally accessible recess 48, into which the tapered end of the lower valve block part 16 protrudes.

The end of the piston rod 20 protruding out from the lower valve block part 16 of the valve block 14 is forked, with a sprocket wheel 50 being rotatably supported on a bolt 52 between the forks of the lower valve block part 16.

At the front end of the press carriage 12, a press ram is seated as a pressing tool in a support 54, namely, in the embodiment example shown, in the form of an hexagon-head ram 56 in whose axial extension a flange bushing 58 is mounted in the press carriage 12.

A piston rod 60 is slidably supported in the flange bushing 58. The thickened end of this piston rod 60 adjacent the die serves as a piston to which a coaxial ejector pin 64 is connected, which ejector pin 64 is slidably supported in the press carriage 12 and in the hexagon-head ram 56. Thus, the piston 62 slides within a cylinder bore 66 of the press carriage 12, which also terminally receives the flange of the flange bushing 58.

The cylinder bore 66 and the piston 62 form a pneumatic aggregate as part of a device for resetting the ejector pin 64. The piston rod 60 contacts a stop 68 with its end remote from the die, said stop 68 being mounted on the press carriage 12 and protruding into the recess 48.

The front surface of the piston rod 60, which also protrudes into the recess 48, is provided with a chamfered part 70 toward the stop 68, on its side facing the sprocket wheel 50, said chamfered part 70 serving as a trip cam cooperating with the sprocket wheel 50, as will be described in more detail below.

The press carriage 12 is further provided with two pressure air feed and withdrawal lines 72 and 74, which terminate in the cylinder bore 66 and are part of the resetting means for the ejector pin 64.

The action of the illustrated arrangement of a ram-side ejector device will now be described below:

In the description, reference shall be made to the condition according to FIG. 1, wherein the press carriage 12 is at its rear dead center (remote from the die) before the beginning of a pressing and shaping operation. The piston rod 22 (consisting of the piston rod part 20 with the sprocket wheel 50 attached thereto, the part 20' and the thickened end part 30), the piston 24 and the plunger 34, which are arranged approximately centrally and vertically above the piston rod 60 in this case, are hydraulically moved to their rear end position (retracted end position). The ejector pin 64 and the pneumatic aggregate (consisting of the piston rod 60 and the piston 62) are also moved, as an integral unit, to their rear position (remote from the die), and the end of the piston rod 60 remote from the die directly contacts the stop 68 of the press carriage 12.

Therefore, in a forward movement (i.e. toward the left as seen in the Figure)of the press carriage 12 driven by the crankshaft 44, the hexagon-head ram 56 located in the support 54 at the front end of the press carriage 12 urges a semi-finished workpiece 76 (FIG. 1) supplied, for example, by a transfer means known, e.g., from DE 40 02 347 A1, of the progressively operating shaping machine or multi-stage press for transferring a partially worked workpiece from one station to the next station for a further processing operation, toward a die 80 fixed relative to the frame and further shapes said workpiece 76, with a hexagon-head of a resulting screw 76' (FIGS. 3 and 4) being formed, corresponding to the press ram 56.

Figure 2:
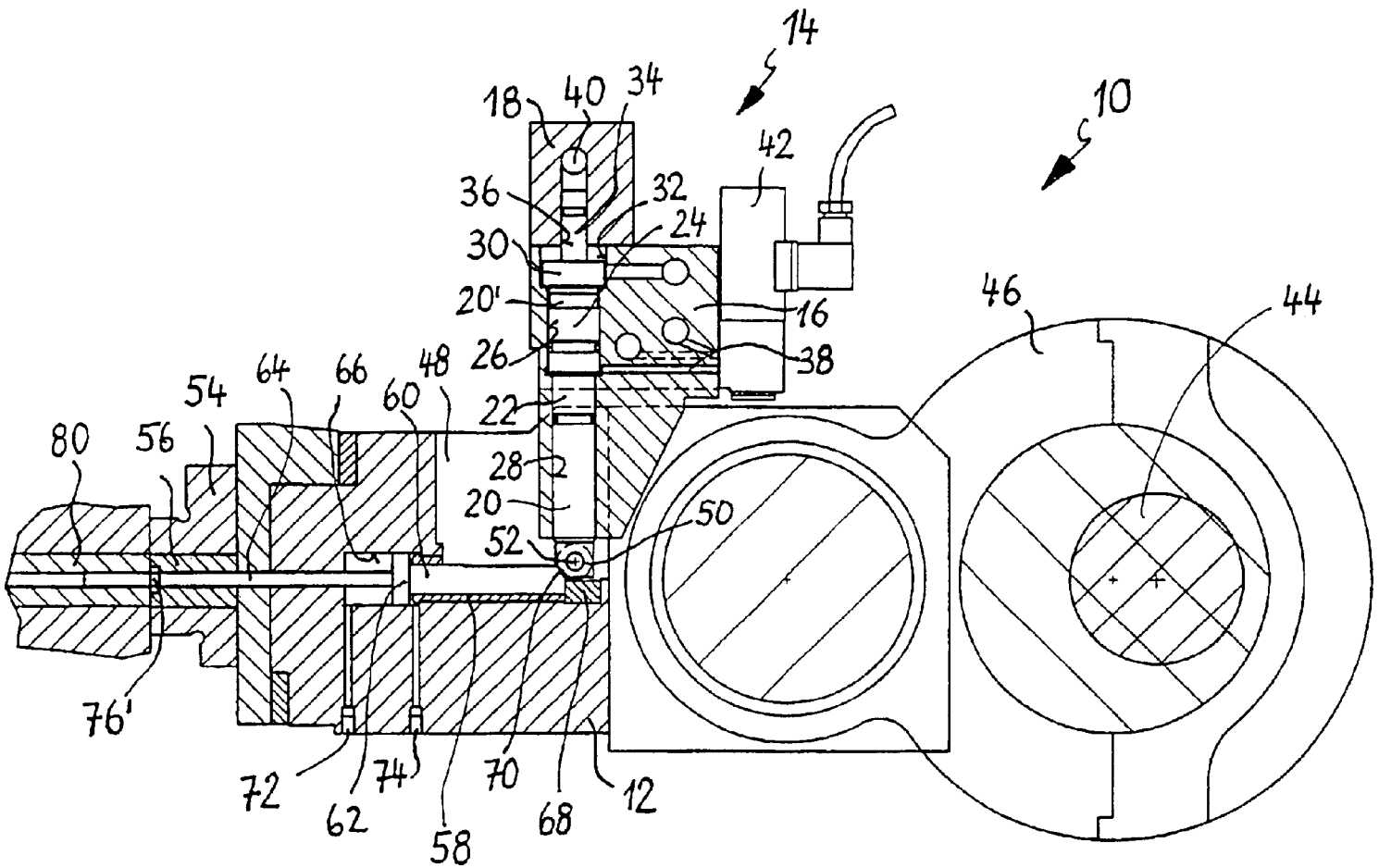
FIG. 2 shows the ram-side ejector device of FIG. 1 (again in a side view in partial section), but this time in a second, front end position, just before the beginning of an ejection operation (at the front dead center of the press carriage)

At the front dead center of the press carriage 12 (as shown in FIG. 2), the ejector pin 64 with the piston 62 and the piston rod 60 still contact the stop 68 of the press carriage 12. When the ram 56 strikes the workpiece 76, part of the shaping force is guided into the press carriage 12 via the ejector pin 64, the piston 62, the piston rod 60 as well as the stop 68.

During this manufacturing stage, the workpiece 76' is given its final shape in the tools (namely the die 80 and the hexagon-head ram 56), i.e. it is provided, in this case, with the desired hexagon-head. Due to the pressing operation, the finished workpiece 76' is stuck in the ram 56 with its tip-stretched hexagon-head.

Shortly before transgressing the front dead center, the program control of the shaping press now switches the hydraulic valve 42. Then, hydraulic pressure is applied via the hydraulic line 40 to the plunger 34 provided as a piston, so that the plunger 34 acting as a piston and the piston rod/piston unit consisting of parts 30, 20', 24 and 20 are moved to their front end position together with the sprocket wheel 50. The sprocket wheel 50 now contacts the trip cam 70 of the piston rod 60, as is evident from FIG. 2.

Thus, the desired ram-side ejection of the finished workpiece 76' is effected during the subsequent return movement of the press carriage 12 upon transgression of the front dead center.

During the return movement of the carriage, the ejector pin 64 remains in the (stationary) end position shown in FIG. 2, due to the piston rod 60 being blocked or locked by the sprocket wheel 50 and by the trip cam 70 of the piston rod 60. From the beginning of the return movement of the press carriage 12, the shaped workpiece 76', both ends of which protrude into the recesses of the hexagon-head ram 56 and of the die 80, is held in the stationary die 80 by the ejector pin 64 until the relative movement between the hexagon-head ram 56 and the ejector pin 64 causes the tip-stretched hexagon-head of the workpiece 76' to be fully pushed out of the press ram 56 by the ejector pin 64 (the ejector pin 64 with the piston rod 60 remains stationary relative to the press body).

Figure 3:
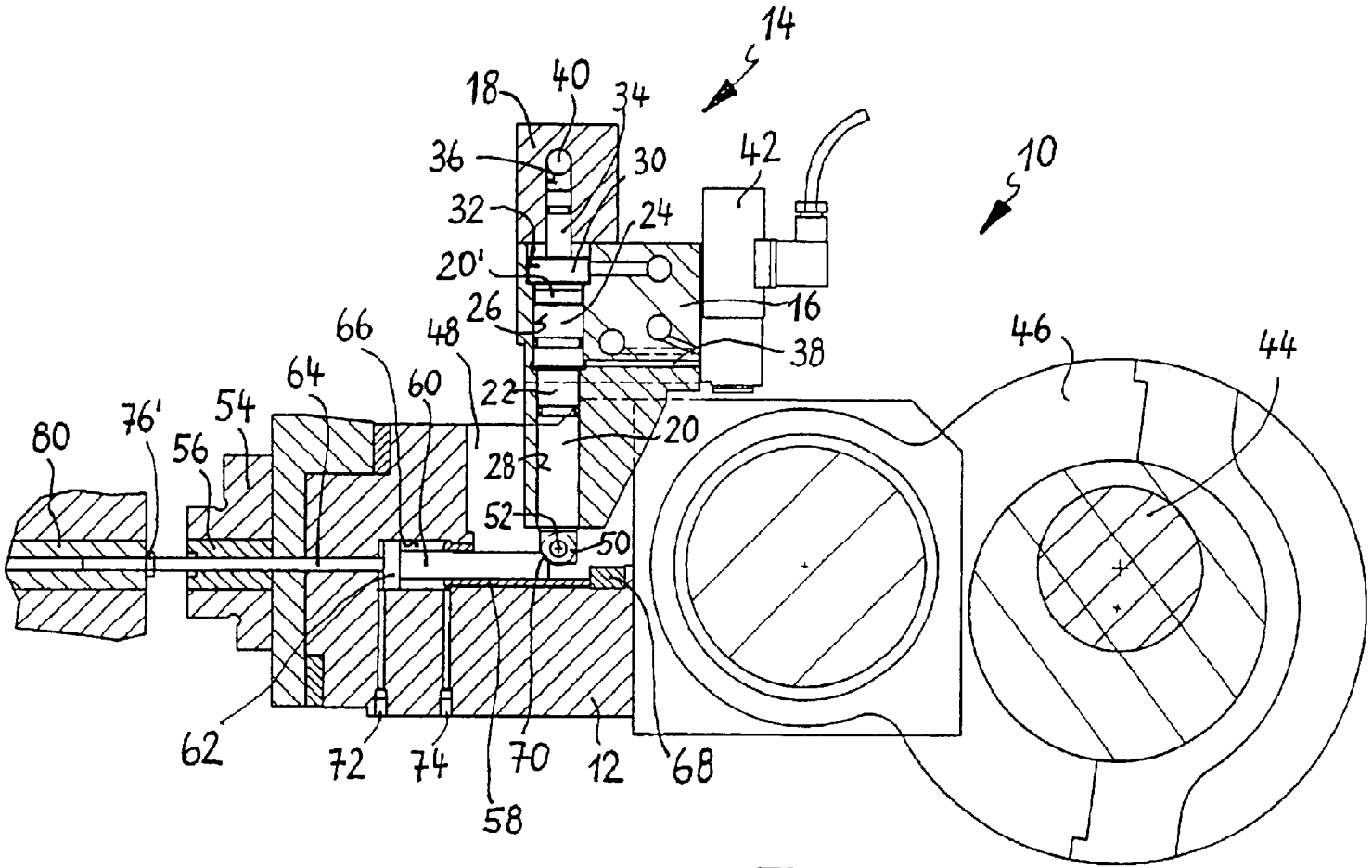
FIG. 3 shows the ram-side ejector device of FIGS. 1 and 2, but after a completed ejection operation.
Figure 4:
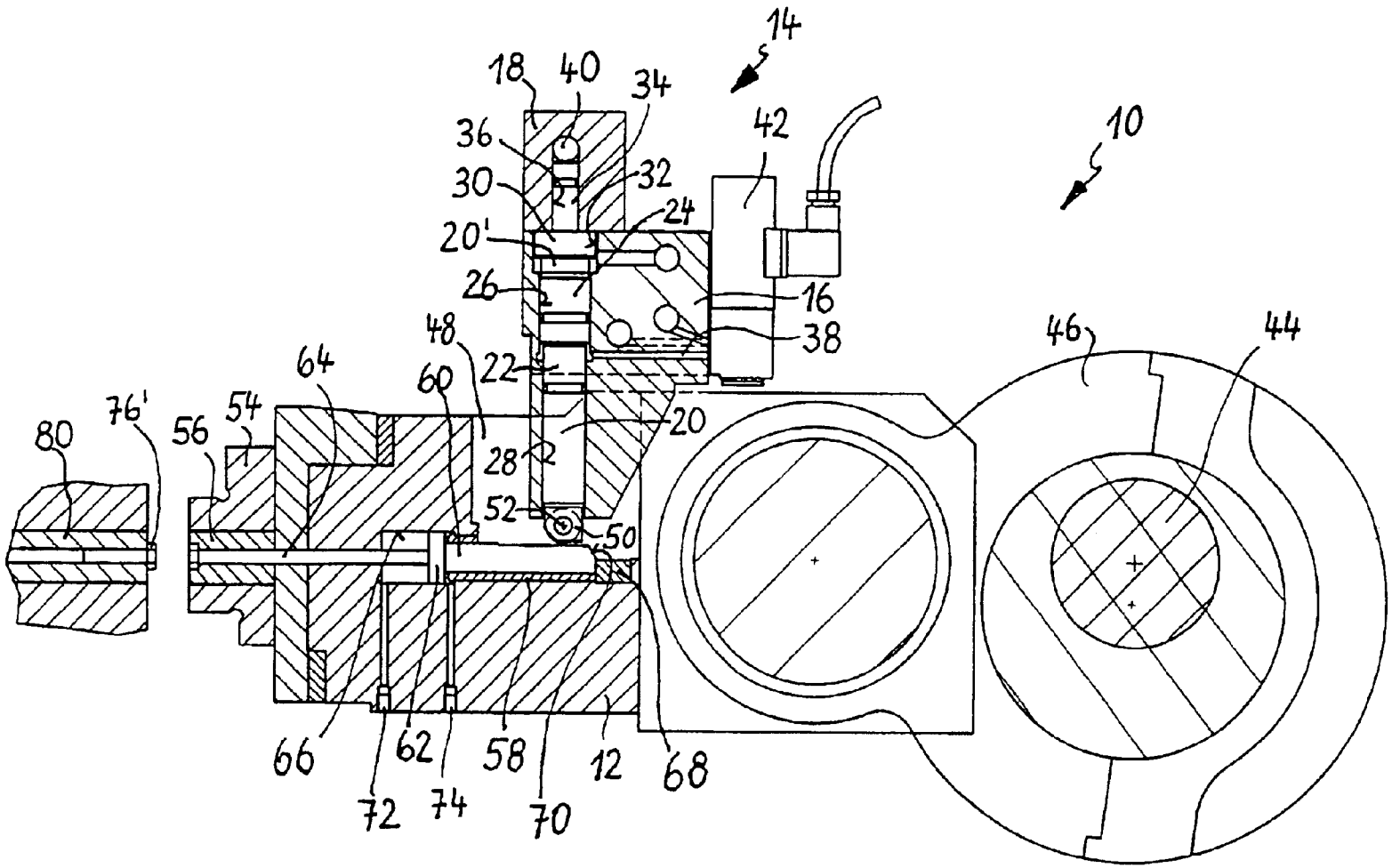
FIG. 4 shows the ram-side ejector device according to FIGS. 1 to 3, but in a condition wherein the ejector pin has returned again to its (rear) end position, retracted into the press carriage.

The stop 68 of the press carriage 12 is now at a distance from the end of the piston rod 60 remote from the die (cf. FIG. 3).

Finally, the hydraulic valve 42 is excited again, in a programmable manner, by the control of the shaping press, and, thus, hydraulic pressure is applied to the piston 24 via the hydraulic line 38 on the side of the piston rod so that the piston 24, together with the piston rod parts 20 (including the sprocket wheel 50), 20' and 30 as well as the plunger 34 return to their rear end position, which is at the same time the starting position for a new work cycle.

During this time, pressure air is supplied to the piston 62, which is slidably guided in the cylinder bore 66 of the press carriage 12 and along its piston rod 60 in the flange bushing 58, said pressure air being supplied, in a program-controlled manner, via the pressure air connection 72, so that the piston 62 is charged on the piston side, and the piston rod 60, together with the ejector pin 64, is returned until the piston rod 60 contacts the stop 68 of the press carriage 12 again with its end remote from the die. The piston 62 and the piston rod 60 with the ejector pin follow the further movement of the press carriage 12 and thus also return to their starting position. Finally, the press carriage 12 has reached its rear holding position (rear dead center) again, as shown in FIG. 1.

During this time, the just shaped workpiece 76' is ejected from the die 80 by a die-side ejector (not shown). Further rotation of the crankshaft 44 now starts a new work cycle.

By the programmable selection of the switching time of the hydraulic feedstream from the hydraulic line 38 to the hydraulic line 40 in the valve block parts 16 and 18, respectively, via the hydraulic valve 42 during the return movement of the press carriage 12, the stand-still time of the ejector pin 64 with the piston 62 and the piston rod 60 (i.e. the time period during which a movement of the ejector pin 64 in the return direction of the press carriage 12 is blocked) and, thus, the ejector stroke can be determined or adjusted. Accordingly, in multi-stage presses, each ejector pin 64 can be adjusted individually via the program control of the press.

Now, if the piston 62 of the described resetting means for the ejector pin 64, however, is charged with pressure air via the pressure air connection 74, i.e. on the piston side, during a certain time period in the program sequence of the shaping press, the ejector pin 64 can even be displaced in its extension direction and used, e.g. to push a prefabricated workpiece into the die 80 and to hold it there, in order to then yield in a resilient manner during the actual pressing operation, upon which one switches back to the piston-side air supply again.

The hydraulic aggregate of the described ejector device 10 consists of the plunger 34, the piston 24 as well as the piston rod parts 20, 20' and 30, and the sprocket wheel 50 rotatably supported on the end of the piston rod 20 as well as the inclination of the trip cam 70 represent a releasable lock for locking by force, which may simultaneously be used as an overload safety device, works free from wear and is adjustable. Said overload safety device responds in order to protect the shaping press if the force by which the workpiece 76' has to be ejected from the press ram 56 by means of the ejector pin 64 exceeds an adjusted level (maximum admissible force level), for example, due to tool breakage. In this case, the sprocket wheel with the piston rod part 20, the piston 24 as well as the piston rod parts 20' and 30 and the plunger 34 lift themselves up from the trip cam 70 against the hydraulic force resulting from the charged area of the plunger 34 and from the pressure of the hydraulic fluid from the hydraulic line 40, and release the force-fit blocking or locking because the holding force adjusted in a programmable manner has been exceeded. This is recognized by the program control of the shaping press, upon which the latter is immediately stopped. Once the cause for such overload in the system has been eliminated, the system is ready-for-use again.

What is claimed is:

1. A ram-side ejector device for workpieces in single- or multi-stage presses, said presses comprising a press carriage, which is movable between a pressing position extended relative to a stationary press die and an end position at a distance therefrom and comprises a press ram cooperating with the stationary press die, said presses further comprising an ejector pin carried on the press carriage in a pressing direction and penetrating the press ram, said ejector pin being movable between a retracted end position, in which it is supported, by its end remote from the die, on a stop formed on the press carriage, and an extended position protruding from the press ram, wherein an end of said pin remote from the die is distanced from the stop, said pin being provided with a resetting means which acts counter to a direction in which said pin is extended and which may be releasably blocked, when the press carriage returns from its pressing position, by a blocking means fixed to the press frame, counter to return movement of the press carriage, activation or deactivation of the blocking means and activation of the resetting means being program-controlled and coupled with each other, characterized in that the blocking means comprises a positionally adjustable blocking element, which may be moved into blocking engagement in the pressing position of the press carriage with the ejector pin or with a part connected therewith, while the ejector pin contacts the stop.

2. The ejector device as claimed in claim 1, wherein the blocking element is a shaped part which, for blocking the ejector pin, is sized to a complementary shape thereon or on a part connected therewith.

3. The ejector device as claimed in claim 2, wherein the shaped part is a sprocket wheel.

4. The ejector device as claimed in claim 2, wherein the shaped part is mounted on a piston rod which is slidably supported in a valve block and is displaceable, by means of a pressurized fluid, between an extended blocking position and an end position retracted into the valve block without blocking engagement.

5. The ejector device as claimed in claim 4, wherein the piston rod is hydraulically actuated.

6. The ejector device as claimed in claim 1, wherein the end of the ejector pin remote from the die is connected to a piston rod on which the shape for the blocking engagement with the blocking element is provided.

7. The ejector device as claimed in claim 6, wherein a chamfered surface is provided as a contacting surface for the shaped part at the end of the piston rod remote from the die, on its side facing the blocking element.

8. The ejector device as claimed in claim 1, wherein the ejector pin is also adjustable in its extension direction by the resetting means.

9. The ejector device as claimed in claim 1, wherein the blocking means protrudes into a recess in the press carriage until it is close to the ejector pin or to the part connected therewith.

10. A ram side ejector device for a press, the press comprising a press frame, a press carriage, and a stationary press die, the press carriage movably mounted to the press frame in a pressing direction to a pressing position extended relative to the stationary press die and to an end position at a distance therefrom, said press carriage comprising a press ram cooperating with the stationary press die, the ram-side ejector comprising: an ejector pin carried on the press carriage in the pressing direction and penetrating the press ram, said ejector pin being movable between a retracted end position, in which it is supported, by its end remote from the die, with said ejector pin or a part connected therewith in contact with a stop formed on the press carriage, and an extended position protruding from the press ram, wherein an end of said pin remote from the die is distanced from the stop, said ejector pin being ressetable in a direction opposite in which said pin is extended, and a blocking mechanism attached to the press frame, said blocking mechanism having a positionally adjustable blocking element which may be moved into blocking engagement with the ejector pin or with a part connected therewith in the pressing position of the press carriage, while the ejector pin or part connected therewith contacts the stop for releasably blocking the ejector pin when the press carriage returns from its pressing position, whereby the pin moves counter to the return movement of the press carriage to the extended position, said blocking device being cyclically retractable to permit resetting of the ejector pin.

11. The ram side ejector device of claim 10, wherein the blocking mechanism comprises a hydraulically controlled piston operating in a direction transverse to the movement of the carriage and that comprising an obstruction portion that contacts the ejector pin or a component attached thereto.

12. The ram side ejector device of claim 10 wherein the activation or deactivation of the blocking mechanism and the resetting of the ejector pin is program-controlled and coupled with each other.

13. A press comprising: a press frame; a stationary press die mounted to the press frame; a press carriage mounted to the press frame and which is movable in a pressing direction to a pressing position extended relative to the stationary press die and to an end position at a distance therefrom, said press carriage comprising a press ram cooperating with the stationary press die; an ejector pin carried on the press carriage in the pressing direction and penetrating the press ram, said ejector pin being movable between a retracted end position, in which it is supported, by its end remote from the die, with said ejector pin or a part connected therewith in contact with a stop formed on the press carriage, and an extended position protruding from the press ram, wherein an end of said pin remote from the die is distanced from the stop, said ejector pin being ressetable in a direction opposite in which said pin is extended, and a blocking mechanism attached to the press frame, said blocking mechanism having a positionally adjustable blocking element which may be moved into blocking engagement with the ejector pin or with a part connected therewith in the pressing position of the press carriage, while the ejector pin or part connected therewith contacts the stop for releasably blocking the ejector pin when the press carriage returns from its pressing position, whereby the pin moves counter to the return movement of the press carriage to the extended position, said blocking device being cyclically retractable to permit the resetting of the ejector pin.

14. The press of claim 13, wherein the blocking mechanism comprises a hydraulically controlled piston operating in a direction transverse to the movement of the carriage and that comprising an obstruction portion that contacts the ejector pin or a component attached thereto.

15. The press of claim 14 wherein activation or deactivation of the blocking mechanism and the resetting of the ejector pin is program-controlled and coupled with each other.

16. The press of claim 13 wherein the blocking mechanism is rotationally mounted.

17. The press of claim 13, wherein the blocking mechanism is a shaped part which, for blocking the ejector pin, is sized to a complementary shape thereon or on a part connected therewith.

* * * * *